US009506010B2

(12) United States Patent
Narita

(10) Patent No.: US 9,506,010 B2
(45) Date of Patent: Nov. 29, 2016

(54) LUBRICANT COMPOSITION AND CONTINUOUSLY-VARIABLE TRANSMISSION

(75) Inventor: Keiichi Narita, Ichihara (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 21 days.

(21) Appl. No.: 13/391,792

(22) PCT Filed: Sep. 15, 2010

(86) PCT No.: PCT/JP2010/065943

§ 371 (c)(1),
(2), (4) Date: Feb. 22, 2012

(87) PCT Pub. No.: WO2011/037054

PCT Pub. Date: Mar. 31, 2011

(65) Prior Publication Data

US 2012/0149619 A1 Jun. 14, 2012

(30) Foreign Application Priority Data

Sep. 25, 2009 (JP) ..... 2009-220004

(51) Int. Cl.

| | |
|---|---|
| ***C10M 169/04*** | (2006.01) |
| ***C10M 163/00*** | (2006.01) |
| *C10M 137/04* | (2006.01) |
| *C10M 133/04* | (2006.01) |

(52) U.S. Cl.

CPC ..... *C10M 163/00* (2013.01); *C10M 169/04* (2013.01); *C10M 133/04* (2013.01); *C10M 137/04* (2013.01); *C10M 2207/027* (2013.01); *C10M 2207/028* (2013.01); *C10M 2207/262* (2013.01); *C10M 2207/289* (2013.01); *C10M 2209/084* (2013.01); *C10M 2215/04* (2013.01); *C10M 2215/08* (2013.01); *C10M 2215/086* (2013.01); *C10M 2215/28* (2013.01); *C10M 2219/042* (2013.01); *C10M 2219/046* (2013.01); *C10M 2219/106* (2013.01); *C10M 2223/04* (2013.01); *C10M 2223/041* (2013.01); *C10M 2223/049* (2013.01); *C10M 2223/06* (2013.01); *C10M 2229/02* (2013.01); *C10N 2210/02* (2013.01); *C10N 2230/06* (2013.01); *C10N 2230/76* (2013.01); *C10N 2240/045* (2013.01)

(58) Field of Classification Search

USPC ..... 508/390, 391, 460, 531, 545, 564
See application file for complete search history.

(56) References Cited

U.S. PATENT DOCUMENTS

| | | | | |
|---|---|---|---|---|
| 4,588,415 | A * | 5/1986 | Zaweski et al. | 44/326 |
| 4,795,583 | A | 1/1989 | Papay | |
| 5,578,235 | A * | 11/1996 | Jao et al. | 508/391 |
| 6,329,327 | B1 * | 12/2001 | Tanaka et al. | 508/362 |
| 2005/0059561 | A1 | 3/2005 | Ozbalik et al. | |
| 2005/0192185 | A1 | 9/2005 | Saathoff et al. | |
| 2007/0004603 | A1 * | 1/2007 | Iyer et al. | 508/441 |
| 2007/0042916 | A1 | 2/2007 | Iyer et al. | |
| 2007/0066498 | A1 | 3/2007 | Ozbalik et al. | |
| 2007/0293406 | A1 | 12/2007 | Henly et al. | |

FOREIGN PATENT DOCUMENTS

| | | |
|---|---|---|
| JP | 59 071395 | 4/1984 |
| JP | 01 259096 | 10/1989 |
| JP | 2000-355695 | 12/2000 |
| JP | 2001 081489 | 3/2001 |
| JP | 2001 288488 | 10/2001 |
| JP | 2005 240033 | 9/2005 |
| JP | 2007 009210 | 1/2007 |
| JP | 2007-217596 | 8/2007 |
| JP | 2007 332377 | 12/2007 |
| JP | 2009 167337 | 7/2009 |
| WO | 2009 090914 | 7/2009 |

OTHER PUBLICATIONS

International Search Report issued on Dec. 7, 2010 in PCT/JP10/065943 filed on Sep. 15, 2010.
Extended European Search Report issued on May 6, 2013 in the corresponding European Patent Application No. 10818729.5.
Japanese Office Action issued Aug. 26, 2014, in Japan Patent Application No. 2011-532972 (with English translation).

* cited by examiner

*Primary Examiner* — Taiwo Oladapo
(74) *Attorney, Agent, or Firm* — Oblon, McClelland, Maier & Neustadt, L.L.P.

(57) ABSTRACT

A lubricating oil composition is provided by mixing a lubricant base oil with components (A) to (C) as follows:
(A) a tertiary amine represented by a formula (1) below,

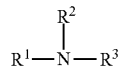

(1)

where: $R^1$ is a hydrocarbon group having 16 to 22 carbon atoms and $R^2$ and $R^3$ independently represent a hydrocarbon group having 1 to 2 carbon atoms, $R^2$ and $R^3$ being adapted to form a heterocyclic ring with terminal ends thereof being bonded;
(B) at least one of acid phosphate and acid phosphite; and
(C) at least one of metal sulfonate, metal phenate and metal salicylate.

16 Claims, No Drawings

LUBRICANT COMPOSITION AND CONTINUOUSLY-VARIABLE TRANSMISSION

RELATED APPLICATION

This application is a national stage entry of PCT/JP2010/065943, filed Sep. 15, 2010 which claims foreign priority of Japanese Patent Application No. 2009-220004, filed Sep. 25, 2009, which are incorporated by reference in their entirety.

TECHNICAL FIELD

The present invention relates to a lubricating oil composition suitable for a continuously variable transmission and a continuously variable transmission filled with the same.

BACKGROUND ART

In recent years, continuously variable transmissions (e.g. metallic belt type and troidal type) have been developed as transmissions for automobiles and the like and have been put into practical use. At first, a lubricant oil for automatic transmission was used for a lubricant oil of the continuously variable transmissions. However, more superior performance has come to be demanded for a lubricant oil in accordance with improvement in the performance of the continuously variable transmissions. Especially, since the friction characteristics of the lubricant oil used for a wet clutch of automatic transmissions are optimized for automatic transmissions, when the lubricant oil for automatic transmissions is used for continuously variable transmissions, friction coefficient between metals is likely to become insufficient to make it difficult to transmit a large capacity torque.

Therefore, various lubricant oils have been developed for continuously variable transmissions. For instance, a lubricating oil composition disclosed in Patent Literature 1 contains an alkaline earth metal sulfonate or phenate, imide compound and phosphoric compound. A lubricating oil composition disclosed in Patent Literature 2 contains: at least one phosphorous-containing compound selected from a phosphoric monoester, phosphoric diester and phosphorous monoester, the phosphorous-containing compound including a hydrocarbon group having 1 to 8 carbon atoms; and a tertiary amine compound substituted by a hydrocarbon group having 6 to 10 carbon atoms. The lubricating oil compositions disclosed in the Patent Literatures exhibit a high friction coefficient between metals for a lubricant oil for a continuously variable transmissions.

CITATION LIST

Patent Literature

Patent Literature 1: JP-A-2001-288488
Patent Literature 2: JP-A-2009-167337

SUMMARY OF THE INVENTION

Problems to be Solved by the Invention

On the other hand, the continuously variable transmissions are further progressed, where a continuously variable transmission having a torque converter with a lock-up clutch in a starter has now become commercially available. Further, a number of recent continuously variable transmissions employ a function for intentionally slipping a lock-up clutch (slip control) in order to improve fuel consumption in a lock-up speed range or mitigate a shock during a lock-up engagement. When such a slip control is applied, self-excited vibrations (so-called "shudders") are likely to be generated depending on lubricant oils used. Accordingly, it is required for the lubricant oil for a continuously variable transmission to have a long shudder-preventing lifetime. However, though the lubricating oil compositions disclosed in the above-described Patent Literatures 1 and 2 provide a high friction coefficient between metals, the shudder-preventing lifetime for a wet clutch may not be sufficient.

An object of the present invention is to provide a continuously variable transmission that provides a high friction coefficient between metals and a long shudder-preventing lifetime for a wet clutch, and a continuously variable transmission filled with the composition.

Means for Solving the Problem

In order to solve the above-described problems, aspects of the invention provide the following lubricating oil composition and continuously variable transmission fed with the lubricating oil composition:

A lubricating oil composition including: lubricant base oil mixed with the following components (A) to (C).

(A) A tertiary amine represented by a formula (1) below,

[Chemical Formula 1]

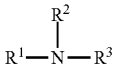

(1)

where $R^1$ is a hydrocarbon group having 16 to 22 carbon atoms and $R^2$ and $R^3$ independently represent a hydrocarbon group having 1 to 2 carbon atoms, $R^2$ and $R^3$ being adapted to form a heterocyclic ring with terminal ends thereof being bonded.

(B) At least one of acid phosphate and acid phosphite.

(C) At least one of metal sulfonate, metal phenate and metal salicylate.

(2) A lubricating oil composition according to the above aspect of the invention, in which a nitrogen content derived from the component (A) is 0.005 mass % or more of a total amount of the composition.

(3) A lubricating oil composition according to the above aspect of the invention, in which a phosphorus content derived from the component (B) is 0.02 mass % or more of a total amount of the lubricating oil composition.

(4) A lubricating oil composition according to the above aspect of the invention, in which the component (C) is at least one of alkaline earth metal sulfonate, alkaline earth metal phenate and alkaline earth metal salicylate.

(5) A lubricating oil composition according to the above aspect of the invention, in which a metal content derived from the component (C) is in a range from 0.01 to 0.1 mass % of a total amount of the lubricating oil composition.

(6) A continuously variable transmission fed with the above lubricating oil composition.

Advantageous Effects of Invention

According to the lubricating oil composition of the aspect of the invention, since the three specific components are mixed with the lubricant base oil, the lubricating oil composition exhibits a high friction coefficient between metals and a long shudder-preventing lifetime for a wet clutch. Thus, the lubricating oil composition of the aspect of the invention is favorably used for a continuously variable transmission equipped with a torque converter having a lock-up clutch.

DESCRIPTION OF EXEMPLARY EMBODIMENT(S)

A lubricating oil composition according to the invention contains a lubricant base oil mixed with the above-described components (A) to (C). The invention will be described below in detail.

Lubricant Base Oil

As the lubricant base oil used in the invention, at least one of a mineral oil and a synthetic oil may be used alone or in a combination of two types or more, or a combination of the mineral oil and the synthetic oil may be used.

Such mineral oil and synthetic oil are not particularly limited, but any mineral oil and synthetic oil are favorable as long as they are generally usable as a base oil for a transmission. Particularly, the lubricant base oil preferably has a kinematic viscosity of 1 $mm^2/s$ to 50 $mm^2/s$, more preferably 2 $mm^2/s$ to 15 $mm^2/s$ at 100 degrees C. When the kinematic viscosity is too high, a low temperature viscosity may be deteriorated. When the kinematic viscosity is too low, wear at a sliding portion such as a gear bearing and a clutch in the continuously variable transmission may be increased.

A pour point, which is an index of a low temperature fluidity of the lubricant base oil, is not limited, but is preferably minus 10 degrees C. or lower, particularly minus 15 degrees C. or lower.

The lubricant base oil preferably has a saturated hydrocarbon component of 90 mass % or more, a sulfur component of 0.03 mass % or less and a viscosity index of 100 or more. When the saturated hydrocarbon component is less than 90 mass %, degraded products may be increased. Moreover, when the sulfur component is more than 0.03 mass %, degraded products may also be increased. Further, when the viscosity index is less than 100, wear at a high temperature may be increased.

Examples of the mineral oil include a naphthenic mineral oil, a paraffinic mineral oil and GTL WAX. Specifically, the mineral oil is exemplified by a light neutral oil, a medium neutral oil, a heavy neutral oil, bright stock and the like that are produced by solvent purification or hydrogenation purification.

Examples of the synthetic oil include polybutene or hydride thereof, poly-α-olefin (1-octene oligomer, 1-decene oligomer and the like), α-olefin copolymer, alkyl benzene, polyol esters, diacid esters, polyoxyalkylene glycol, polyoxyalkylene glycol esters, polyoxyalkylene glycol ethers, hindered esters, silicone oil and the like.

Component (A)

The component (A) used in the present invention is a tertiary amine represented by the above formula (1). Here, $R^1$ represents a hydrocarbon group having 16 to 22 carbon atoms. In either case in which the number of carbon atoms is less than 16 or exceeds 22, it is difficult to increase the friction coefficient between metals. Examples of the above hydrocarbon group include alkyl group, alkenyl group, aryl group and aralkyl group. In the hydrocarbon groups, an aliphatic hydrocarbon group is preferable, in which a saturated hydrocarbon group is more preferable. Accordingly, examples of $R^1$ include hexadecyl group, heptadecyl group, octadecyl group, nonadecyl group, eicosyl group, heneicosyl group and docosyl group. Among the above, an octadecyl group is the most preferable.

Further, though the carbon chain may be linear or branched, a linear structure is preferable.

Each of $R^2$ and $R^3$ independently represents a hydrocarbon group having 1 to 2 carbon atoms. Specifically, $R^2$ and $R^3$ include methyl group, ethyl group and vinyl group. When the number of carbon atoms of at least one of $R^2$ and $R^3$ is 3 or more, the shudder-preventing lifetime may be adversely affected. In addition, methyl group or ethyl group is more preferable in terms of stability than a vinyl group that has an unsaturated structure. $R^2$ and $R^3$ may form a heterocyclic ring with terminal ends thereof being bonded.

Specific examples of the component (A) include dimethyl hexadecyl amine, dimethyl octadecyl amine, dimethyl heneicosyl amine, diethyl octadecyl amine and methyl ethyl octadecyl amine and the like. The tertiary amine as the components (A) may be singularly used or a combination of two or more thereof may be used.

The content of nitrogen derived from the component (A) is preferably 0.005 mass % or more of the total amount of the composition in view of the shudder-preventing effect and shudder-preventing lifetime, more preferably 0.01 mass % or more and further more preferably 0.02 mass % or more. However, too much amount of the component (A) saturates the shudder-preventing effect and the effect on the shudder-preventing lifetime. Accordingly, it is preferable that the blend ratio is restricted so that the content of the nitrogen derived from the component (A) becomes 0.1 mass % or less.

Component (B)

The component (B) used in the invention is at least one of acid phosphate and acid phosphite. Specifically, the component (B) is exemplified by phosphoric acid monoester and phosphoric acid diester represented by the following formula (2) and acid phosphite represented by the following formula (3).

[Chemical Formula 2]

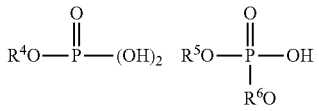

(2)

[Chemical Formula 3]

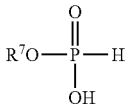

(3)

In the above formulae (2) and (3), $R^4$, $R^5$, $R^6$ and $R^7$ each are a hydrocarbon group, particularly preferably, a hydrocarbon group having 8 or less carbon atoms. When the number of carbon atoms of the above hydrocarbon group exceeds 8, the friction coefficient between metals may not be enhanced.

Examples of the hydrocarbon group having 8 or less carbon atoms are an alkyl group having 8 or less carbon atoms, an alkenyl group having 8 or less carbon atoms, an aryl group having 6 to 8 carbon atoms and an aralkyl group having 7 or 8 carbon atoms. The alkyl group and alkenyl group may be linear, branched or cyclic. Examples of the alkyl group and alkenyl group include methyl group, ethyl group, n-propyl group, isopropyl group, n-butyl group, isobutyl group, sec-butyl group, tert-butyl group, pentyl groups, hexyl groups, heptyl groups, octyl groups, cyclopentyl group, cyclohexyl group, allyl group, propenyl group, butenyl groups, hexenyl groups, octenyl groups, cyclopentenyl group and cyclohexenyl group.

Examples of aryl group having 6 to 8 carbon atoms include phenyl group, tolyl group and xylyl group. Examples of aralkyl group having 7 to 8 carbon atoms include benzyl group, phenethyl group and methylbenzyl group.

Specific examples of phosphoric acid monoester represented by the formula (2) include mono-ethyl acid phosphate, mono-n-propyl acid phosphate, mono-n-butyl acid phosphate and mono-2-ethylhexyl acid phosphate. Specific examples of phosphoric acid diester represented by the formula (2) include diethyl acid phosphate, di-n-propyl acid phosphate, di-n-butyl acid phosphate and di-2-ethylhexyl acid phosphate. Specific examples of acid phosphite represented by the formula (3) include ethyl hydrogen phosphite, n-propyl hydrogen phosphite, n-butyl hydrogen phosphite and 2-ethylhexyl hydrogen phosphite.

The components (B) of the invention may be singularly used or a combination of two or more thereof may be used. Phosphorus content derived from the component (B) according to the invention is preferably 0.02 mass % or more of the total amount of the composition, more preferably 0.03 mass % or more and 0.09 mass % or less. When the amount of the component (B) is 0.02 mass % or more, the friction coefficient between metals can be enhanced.

Component (C)

The component (C) used in the invention is at least one of metal sulfonate, metal phenate and metal salicylate. With the above metal compound(s) being blended, the friction coefficient between metals can be enhanced. As the metal compound, at least one material selected from a group consisting of alkaline earth metal sulfonate, alkaline earth metal phenate and alkaline earth metal salicylate is preferable in terms of effect. By combining the component (C) of the invention with the above-described component (B), the enhancement of the friction coefficient between metals can be synergistically exhibited.

An example of alkaline earth metal sulfonate is an alkaline earth metal salt of alkyl aromatic sulfonic acid obtained by sulfonating an alkyl aromatic compound having a mass average molecular weight of 300 to 1500 (preferably 400 to 700). The alkaline earth metal salt is exemplified by magnesium salt, calcium salt and the like, among which calcium salt is favorably used.

An example of alkaline earth metal phenate is an alkaline earth metal salt of alkylphenol, alkylphenol sulfide and a Mannich reaction product of alkylphenol. The alkaline earth metal salt is exemplified by magnesium salt, calcium salt and the like, among which calcium salt is favorably used.

Examples of the alkaline earth metal salicylate include an alkaline earth metal salt of alkyl salicylic acid, which is exemplified by magnesium salt, calcium salt and the like. Particularly, calcium salt is favorably used.

The above alkaline earth metal compound preferably has a linear or a branched alkyl group. The number of carbon atoms of the alkyl group is in a range from 4 to 30, more preferably in a range from 6 to 18. The alkaline earth metal compound may be any one of neutral salt, basic salt and overbased salt. The total base number of the alkaline earth metal compound is preferably in a range from 10 to 500 mgKOH/g, more preferably in a range from 15 to 450 mgKOH/g.

The content of the metal compound as the component (C) is preferably in a range from 0.01 to 0.1 mass % in terms of metal in the total amount of the composition, more preferably in a range from 0.02 to 0.08 mass %. When the content of the component (C) is less than 0.01 mass %, the effect is unlikely to be exhibited. On the other hand, the content exceeding 0.1 mass % does not provide advantages corresponding to the content. In addition, the specific compounds as the component (C) may be singularly used or a combination of two or more thereof may be used.

The above-described lubricating oil composition of the invention exhibits a high friction coefficient between metals and a consequent large torque transmission capacity, and a long shudder-preventing lifetime. Accordingly, the lubricating oil composition of the invention can be favorably used for various continuously variable transmissions such as a chain type continuously variable transmission equipped with a chain, a belt-type continuously variable transmission equipped with a metallic belt or a troidal type continuously variable transmission.

Other Additives

The lubricating oil composition according to the invention may be added as necessary with other additives such as a viscosity index improver, a pour point depressant, an antiwear agent, a friction modifier, an ashless-type dispersant, a rust inhibitor, a metal deactivator, an antifoaming agent and an antioxidant as long as effects of the invention are not hampered.

Examples of the viscosity index improver are polymethacrylate, dispersed polymethacrylate, an olefin-based copolymer (such as an ethylene-propylene copolymer), a dispersed olefin-based copolymer and a styrene-based copolymer (such as a styrene-diene copolymer and a styrene-isoprene copolymer). In view of blending effects, the content of the viscosity index improver is in a range about from 0.5 to 15 mass % of a total amount of the lubricating oil composition.

Examples of the pour point depressant include polymethacrylate having a mass average molecular weight of about 10000 to 150000. The content of the pour point depressant is preferably in a range about from 0.001 to 10 mass % of the total amount of the composition.

Examples of the antiwear agent include a sulfur antiwear agent such as thiophosphate metal salt (e.g. Zn, Pb and Sb) and thiocarbamate metal salt (e.g. Zn) and a phosphorus antiwear agent such as phosphate (tricresyl phosphate). The content of the antiwear agent is preferably in a range about from 0.05 to 5 mass % of the total amount of the composition.

Examples of the friction modifier include a polyhydric alcohol partial ester such as neopentyl glycol monolaurate, trimethylol propane monolaurate, and glycerin monooleate (monoglyceride oleate). The content of the antiwear agent is preferably in a range about from 0.05 to 4 mass % of the total amount of the composition.

Examples of the ashless dispersant include: succinimides; boron-containing succinimides; benzylamines; boron-containing benzyl amines; succinates; and monovalent or divalent carboxylic amides represented by fatty acid or succinic acid. The content of the ashless dispersant is preferably in a range about from 0.1 to 20 mass % of the total amount of the composition.

Examples of the rust inhibitor include a fatty acid, alkenyl succinic acid half ester, fatty acid soap, alkyl sulfonate, polyhydric alcohol fatty acid ester, fatty acid amine, paraffin oxide and alkyl polyoxyethylene ether. The content of the rust inhibitor is preferably in a range about from 0.01 to 3 mass % of the total amount of the composition.

Examples of the metal deactivator include benzotriazole and thiadiazole, which are used either singularly or in combination of two or more thereof. The content of the metal deactivator is preferably in a range about from 0.01 to 5 mass % of the total amount of the composition.

Examples of the antifoaming agent include silicone compounds and ester compounds, which are used either singularly or in combination of two or more thereof. The content of the antifoaming agent is preferably in a range about from 0.05 to 5 mass % of the total amount of the composition.

An antioxidant of hindered phenol type and amine type or zinc alkyldithiophosphate (ZnDTP) are favorably used. A bisphenol antioxidant and an ester-group-containing phenol antioxidant are particularly preferable among the phenol type antioxidant. A dialkyl diphenylamine antioxidant and a naphthylamine antioxidant are preferable among the amine type antioxidant. The content of the antioxidant is preferably in a range about from 0.05 to 7 mass % of the total amount of the composition.

EXAMPLES

The invention will be described in more detail below with reference to examples and comparatives. It should be noted that the invention is not limited to the description of the following Examples and the like.

Examples 1 and 2 and Comparatives 1 to 6

Lubricating oil compositions respectively structured as shown in Table 1 were prepared, and a friction coefficient between metals and a clutch shudder-preventing lifetime of each composition were measured. The results are also shown in Table 1.

Friction Coefficient Between Metals: LFW-1 Test

The friction coefficient between metals was measured using a block-on-ring tester (LFW-1) according to ASTM D2174. Specific testing conditions were as follows.

Test Jig

Ring: Falex 5-10 Test Ring (SAE4620 Steel)

Block: Falex H-60 Test Block (SAE01 Steel)

Test Conditions

Oil Temperature: 110 degrees C.

Load: 1,176N

Slip Speed: Kept at 1.0, 0.5, 0.25, 0.125 and 0.075 m/s in this order respectively for five minutes Friction Coefficient: Value measured for 30 seconds before changing the slip speed (Trial run was conducted under the conditions of: oil temperature at 110 degrees C.; load at 1,176 N; slip speed of 1 m/s; and time for 30 minutes.)

Clutch Shudder-Preventing Lifetime

The clutch shudder-preventing lifetime was evaluated according to JASO M349-1998. Specific test conditions were as follows. The clutch shudder-preventing lifetime was defined as a time elapsed before a ratio between friction coefficients at 1 rpm and 50 rpm ($\mu_1/\mu_{50}$) fell to 1 or less.

Endurance Test Conditions

Friction material: cellulose disc/steel plate

Oil amount: 150 ml

Face pressure: 1 MPa

Oil temperature: 120 degrees C.

Slip Speed: 0.9 m/s

Slip time: 30 minutes

Suspension time: 1 minute

Performance measurement: μ-V properties were measured for every 24 hours after the test started.

(Trial run was conducted under the conditions of: oil temperature being at 80 degrees C.; face pressure at 1 MPa; slip speed of 0.6 m/s; and time for 30 minutes.)

TABLE 1

| | base oil [1)] | Ex. 1 remaining part | Ex. 2 remaining part | Comp. 1 remaining part | Comp. 2 remaining part | Comp. 3 remaining part | Comp. 4 remaining part | Comp. 5 remaining part | Comp. 6 remaining part |
|---|---|---|---|---|---|---|---|---|---|
| Composition ratio (mass %) | dimethyloctadecyl amine: component (A) | 0.4 | 0.4 | — | — | — | — | 0.4 | 0.4 |
| | trioctyl amine | — | — | 0.4 | — | — | — | — | — |
| | 2-ethylhexyl hydrogen phosphite: component (B) | 0.25 | — | 0.25 | 0.25 | 0.25 | 0.25 | 0.25 | — |
| | 2-ethylhexyl acid phosphate: component (B) | — | 0.25 | — | — | — | — | — | — |
| | tricresyl phosphate | 0.3 | 0.3 | 0.3 | 0.3 | 0.3 | 0.3 | 0.3 | 0.3 |
| | overbased calcium sulfonate: component (C) | 0.4 | 0.4 | 0.4 | 0.4 | 0.4 | 0.4 | — | 0.4 |
| | polymethacrylate (Mw 30000) | 9.5 | 9.5 | 9.5 | 9.5 | 9.5 | 9.5 | 9.5 | 9.5 |
| | oleic amide | — | — | — | 0.4 | — | — | — | — |
| | isostearic amide | — | — | — | — | 0.4 | — | — | — |
| | oleic monoglyceride | 0.25 | 0.25 | 0.25 | 0.25 | 0.25 | 0.25 | 0.25 | 0.25 |
| | polybutenyl succinimide | 4.5 | 4.5 | 4.5 | 4.5 | 4.5 | 4.5 | 4.5 | 4.5 |
| | sulfur antiwear agent | 0.5 | 0.5 | 0.5 | 0.5 | 0.5 | 0.5 | 0.5 | 0.5 |
| | copper deactivator (thiadiazole type) | 0.05 | 0.05 | 0.05 | 0.05 | 0.05 | 0.05 | 0.05 | 0.05 |
| | antifoaming agent (silicone type) | 0.2 | 0.2 | 0.2 | 0.2 | 0.2 | 0.2 | 0.2 | 0.2 |
| Elements in oil (mass %) | nitrogen content: derived from component (A) | 0.02 | 0.02 | — | — | — | — | 0.02 | 0.02 |

TABLE 1-continued

| | base oil [1)] | Ex. 1 remaining part | Ex. 2 remaining part | Comp. 1 remaining part | Comp. 2 remaining part | Comp. 3 remaining part | Comp. 4 remaining part | Comp. 5 remaining part | Comp. 6 remaining part |
|---|---|---|---|---|---|---|---|---|---|
| | phosphorous content: derived from component (B) | 0.03 | 0.03 | 0.03 | 0.03 | 0.03 | 0.03 | 0.03 | — |
| | calsium content: derived from component (C) | 0.05 | 0.05 | 0.05 | 0.05 | 0.05 | 0.05 | — | 0.05 |
| Evaluation Results | LFW-1 friction coefficient between metals | 0.122 | 0.122 | 0.120 | 0.116 | 0.106 | 0.123 | 0.112 | 0.110 |
| | clutch shudder-preventing lifetime (hour) | 336 | 336 | 120 | 72 | 192 | 48 | 312 | 312 |

[1)] base oil: hydrogenated mineral oil (kinematic viscosity at 100 degrees C.: 4.4 $mm^2/s$, viscosity index: 127)

Evaluation Results

As shown in the results of Examples 1 and 2 in Table 1, the lubricating oil composition according to the invention provided by blending components (A) to (C) with the base oil exhibits sufficiently high friction coefficient between metals while exhibiting sufficiently long clutch shudder-preventing lifetime. Accordingly, it is understood that the lubricating oil composition of the invention is suitably used for a continuously variable transmission.

On the other hand, the lubricating oil composition according to Comparatives 1 to 4 contains no component (A) of the invention. Accordingly, the clutch shudder-preventing lifetime is short. Especially, though the lubricating oil composition according to Comparative 1 contains tertiary amine, since the tertiary amine has a structure different from that of the component (A) of the invention, the clutch shudder-preventing lifetime is short. The lubricating oil composition according to Comparative 5 contains no component (C) of the invention, so that the friction coefficient between metals is small and the lubricating oil composition is inferior in torque transmission performance. The lubricating oil composition according to Comparative 6 contains no component (B) of the invention. Thus, the lubricating oil composition also exhibits small friction coefficient between metals and thus is inferior in torque transmission performance.

The invention claimed is:

1. A composition, comprising:

a lubricant base oil;

(A) at least one tertiary amine of the formula (1) that provides a nitrogen content of from 0.005 mass % to 0.1 mass % based on the total mass of the composition:

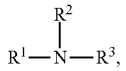

(1)

wherein:

$R^1$ is an alkyl group comprising 16 to 22 carbon atoms, and $R^2$ and $R^3$ are each independently a hydrocarbon group comprising 1 to 2 carbon atoms or $R^2$ and $R^3$ together form a heterocyclic ring;

(B) at least one member selected from the group consisting of 2 ethylhexyl hydrogen phosphite and 2-ethylhexyl acid phosphate that provides a phosphorous content of from 0.02 mass % to 0.09 mass % based on the total mass of the composition;

(C) at least one member selected from the group consisting of an overbased calcium sulfonate, an overbased calcium phenate, and an overbased calcium salicylate that provides a calcium content in an amount of from 0.01 to 0.1 mass % based on the total mass of the composition; and (D) about 0.05 to 5 mass % based on the total mass of the composition of tricresyl phosphate.

2. The composition of claim 1, wherein (A) comprises dimethyl hexadecyl amine.

3. The composition of claim 1, wherein (A) comprises dimethyl octadecyl amine.

4. The composition of claim 1, wherein (A) comprises dimethyl heneicosyl amine.

5. The composition of claim 1, wherein (A) comprises diethyl octadecyl amine.

6. The composition of claim 1, wherein (A) comprises methyl ethyl octadecyl amine.

7. The composition of claim 1, wherein (B) comprises mono-2-ethylhexyl acid phosphate and di-2-ethylhexyl acid phosphate.

8. The composition of claim 1, wherein (B) comprises 2-ethylhexyl hydrogen phosphite.

9. The composition of claim 1, wherein (C) comprises an overbased calcium salt of an alkyl aromatic sulfonic acid.

10. The composition of claim 1, wherein (C) comprises an alkaline earth metal phenate selected from the group consisting of an overbased calcium salt of an alkylphenol, an overbased calcium salt of an alkylphenol sulfide, and an overbased calcium salt of a Mannich reaction product of an alkylphenol.

11. The composition of claim 1, wherein (C) comprises an overbased calcium salt of an alkyl salicylic acid.

12. The composition of claim 1, having the nitrogen content derived from (A) of from 0.01 mass % to 0.1 mass % based on the total mass of the composition.

13. The composition of claim 1, having the phosphorus content derived from (B) of from 0.03 mass % to 0.09 mass % based on the total mass of the composition.

14. The composition of claim 1, having the calcium content derived from (C) in a range from 0.02 to 0.08 mass % based on the total mass of the composition.

15. A continuously variable transmission, comprising:

the composition of claim 1, wherein the composition is fed into the continuously variable transmission.

16. A method for lubricating a continuously variable transmission, the method comprising:

feeding the composition of claim 1 into a continuously variable transmission.

* * * * *